United States Patent [19]

Sarin

[11] 4,433,739

[45] Feb. 28, 1984

[54] MINING DRILL

[75] Inventor: Vinod K. Sarin, Lexington, Mass.

[73] Assignee: GTE Laboratories, Inc., Waltham, Mass.

[21] Appl. No.: 346,971

[22] Filed: Feb. 8, 1982

[51] Int. Cl.[3] ..... E21B 10/62

[52] U.S. Cl. ..... 175/410; 175/418

[58] Field of Search ..... 175/410, 418, 320, 411, 175/415, 417, 327, 213, 419, 420

[56] References Cited

U.S. PATENT DOCUMENTS

| | | | |
|---|---|---|---|
| 1,106,966 | 8/1914 | Pauli | 175/420 |
| 1,318,958 | 10/1919 | Bernay | 175/417 |
| 2,246,447 | 6/1941 | Maclean | 175/417 |
| 3,434,552 | 3/1969 | Bower, Jr. | 175/410 |
| 3,434,553 | 3/1969 | Weller | 175/410 |

FOREIGN PATENT DOCUMENTS

| | | | |
|---|---|---|---|
| 18443 | of 1912 | United Kingdom | 175/410 |
| 669636 | 4/1952 | United Kingdom | 175/410 |

*Primary Examiner*—Stephen J. Novosad
*Assistant Examiner*—Hoang C. Dang
*Attorney, Agent, or Firm*—Robert E. Walter

[57] ABSTRACT

In a mine tool having a drive body, an insert is detachably held to the drive body in a slot formed by forwardly projecting flanges.

1 Claim, 10 Drawing Figures

MINING DRILL

FIELD OF INVENTION

The present invention relates to a mining drill which is particularily useful for drilling coal mine roof bolt holes.

BACKGROUND OF INVENTION

Roof drills are used for drilling holes in rock in the roof of mines for installing roof bolts. The drills are typically in the form of a drive body having a bit at the forward end with a hard wear-resistant material, such as tungsten carbide rigidly secured to the bit.

U.S. Pat. No. 4,190,128 to Emmerich relates to a roof drill having openings in the bit which connect to a hole in the drive body for the passage of air and removal of detritus.

U.S. Pat. No. 3,032,129 to Fletcher et al relates to a drill bit wherein the air is drawn into the drive body through open portions on each side of the bit.

U.S. Pat. No. 3,434,552 to Bower, Jr. relates to a bit having a slot with a cutting insert loosely held within the slot for free endwise sliding movement relative to the slot.

SUMMARY OF INVENTION

During drilling it is desirable to remove detritus, which is comprised of dust, cuttings and bit fragments generated during drilling due to the drilling action of the cutting insert. Inadequate removal results in an increase in the torque required to rotate the mining drill. Suction is typically applied through a passage in the drive body so that detritus can be removed from the hole being drilled.

In accordance with the present invention, there is provided a mine drill for aiding collection of detritus during drilling comprising a drive body being cylindrically shaped about an axis of rotation and having an axial passage for the flow of detritus, an elongated insert mounted at the forward end of said drive body for movement about said axis of rotation whereby leading insert surfaces are presented forward of trailing insert surfaces in the direction of rotation, said insert having forwardly projecting cutting edges, a base surface, side surfaces extending intermediate end portions and normal to said base surface and extending toward said cutting edges, said base surface lying in a plane substantially normal to the axis of rotation, said drive body having a support surface and a pair of insert engaging surfaces projecting in the axial direction, said insert being mounted to said drive body with said base surface engaging said support surface and said respective trailing insert surfaces engaging respective insert engaging surfaces, means for detachably securing said insert to said drive body, said drive body forming a pair of passageways communicating with said axial passage for the flow of detritus.

DRAWINGS

DETAILED DESCRIPTION

Figure 1:
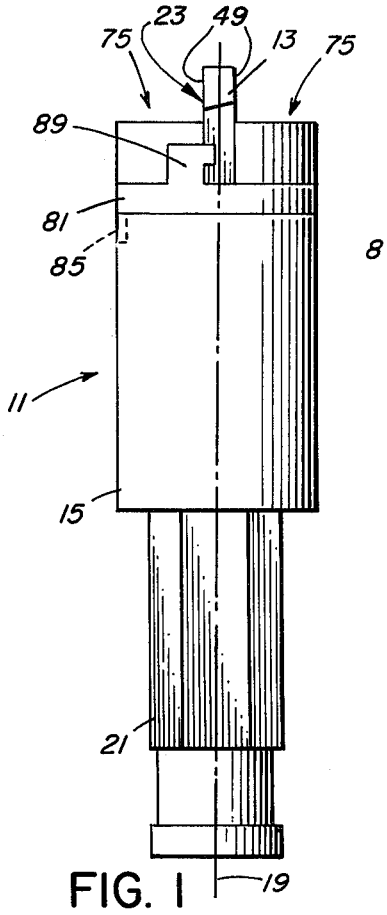
FIG. 1 is a side elevational view of the drill including insert mounted on the drive body.
Figure 2:
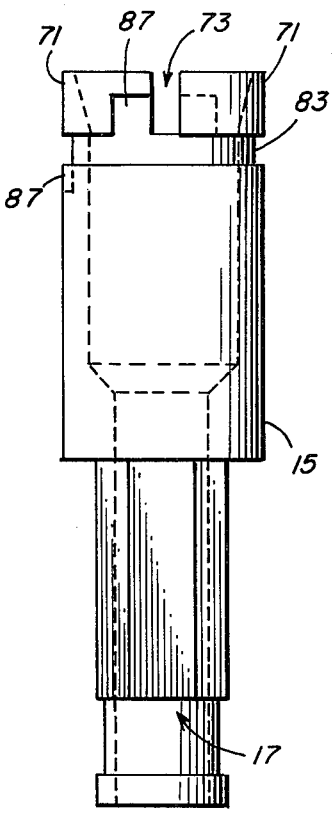
FIG. 2 is a side view of the drive body without an insert or keeper ring.
Figure 3:
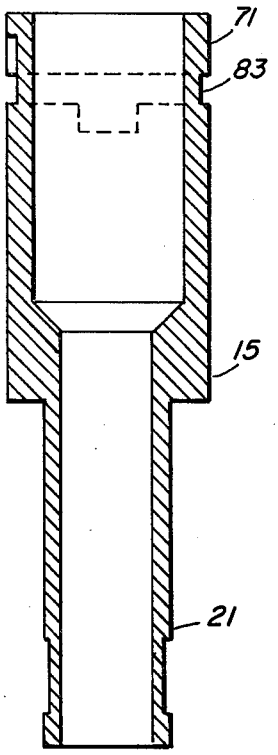
FIG. 3 is a side view of the drive body in section.
Figure 4:
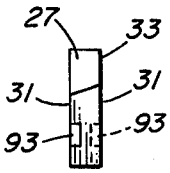
FIG. 4 is an end view of the insert.
Figure 5:
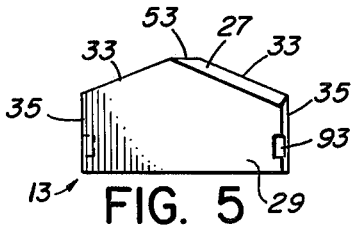
FIG. 5 is a side view of the insert.
Figure 6:
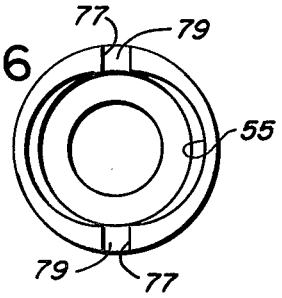
FIG. 6 is an end view of the drive body.
Figure 7:
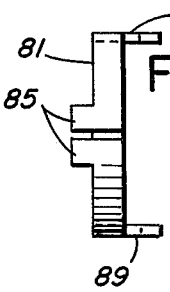
FIG. 7 is a side view of the keeper ring.
Figure 9:
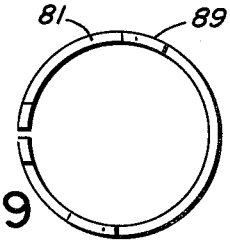
FIG. 9 is an end view of the keeper ring.
Figure 10:
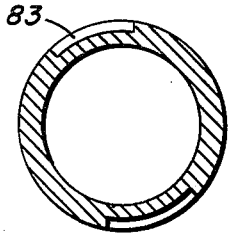
FIG. 10 is a sectional view of the drive body.
Figure 8:
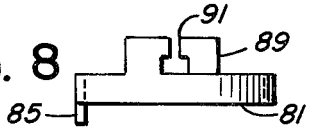
FIG. 8 is another side view of the keeper ring.

FIG. 1 generally illustrates a mining drill 11 comprising an insert 13 mounted on a drive body 15 having an axial passage 17 for the flow of detritus from the cutting area. The insert 13 is formed from a hard material suitable for cutting rock. Typical materials are sintered cemented metal carbides. The drive body 15, is cylindrically shaped and capable of being mounted for movement about an axis of rotation 19. As illustrated in FIG. 1, the rearward end 21 has a hexagonal shape of reduced dimension forming a socket end which can be attached to another drive body having an air passage with a mating hexagonal recess. Multiple drive bodies can be conveniently connected to a drilling machine and vacuum source of a conventional type.

The terms forward and rearward are used for convenience of description and should not be taken as limiting the scope of the invention. For purposes of this description, forward generally refers to axial direction in which the drill is advanced during cutting and rearward is the opposite direction.

An insert 13 which is attached to the forward end 23 of the drive body 15 is detachably secured thereto for movement about the axis of rotation 19. The insert 13 has forwardly projecting lands 27 which form an angle of from about 135° to about 145° and a rectangular base surface 29. Side surfaces 31 extend from respective ends of the base surface 29 toward the forward lands 27 intermediate the end portions 35 of the insert 13. The forward lands 27 meet substantially at the axis of rotation 19 and slope downwardly from the cutting edges 33 in opposite directions on either side of the point at an angle of about 8° to about 12°. The cutting edges 33 are located above the two diagonally opposite corners of the rectangular base surface 29.

During rotation of the insert 13 during cutting, the cutting edges 33 lead the insert 13 so as to make primary cutting contact with the work, i.e. roof rock. For purposes of this description, leading surfaces or edges are intended to refer to edges or surfaces which are first presented to the work in the direction of rotation.

The insert 13 is mounted so that end portions 35 extend in a radial direction outwardly of the drive body 15. Preferably the point 53 of the insert 13 is axially aligned with the axis of rotation 19 and the insert 13 is fixedly held in position. The radial projection of the end portions 35 beyond the drive body 15 creates a hole slightly large than the drive body 15 dimensions. Thus, during drilling, air is supplied or drawn into the drill hole by suction along the exterior of the drive body 15.

The drive body 15 includes pair of forwardly projecting flanges 71 forming diametrically opposed apertures 73. Each of the apertures 73 is adapted to receive one of the respective end portions 35. The flanges 71 which are diametrically opposed extend in a direction forward of the plane of the base surface 29 of the insert 13 when the insert 13 is mounted to the drive body 15. Each of the flanges 71 is spaced from a respective side surface 31 so as to form a respective air passage 75 adapted for the conveyance of detritus during drilling to the axial passage 17.

As illustrated in the drawings, the flanges 71 are preferably an extension of the tubular shape of the drive body 15 formed by the contoured inner surface 55 and outer cylindrical shape. The flanges 71 have a forward end in a plane normal to the axis of rotation. Each of the flanges 71 extend forwardly to a position at least intermediate to the insert base surface 29 and the most rearward position of the cutting edges 33. From a side view of the insert 25, the most rearward position of the cutting edges 33 is along a plane passing through the most rearward portions of each of the cutting edges 33. Preferably the upper surface of the flange at the forward end 23 is forwardly closer to the most rearward portion of the cutting edges 33 than midway the plane of the base surface 29 and the plane of the cutting edges 33. The air passages 75 are thusly positioned closely adjacent the cutting edges 33 of the bit 13 so that air sucked in adjacent the exterior of the drive body 15 preferably reverses direction, increases velocity and forces detritus through the air passages 75.

In the area adjacent the cutting edges 33, the respective air passages 75 which are diametrically opposed are formed by respective insert surfaces 49 and the interior surface of the respective flanges 71.

In accordance with the principles of the present invention, each flange 71 includes an insert engaging surface 71 facing a respective side surface 31. The pair of insert engaging surfaces 71 disengagably transmits substantially all of the torsional forces to the insert 13 during drilling. The insert 13 is provided with a means independent of the means for applying torsional forces to removably hold the insert 13 from movement in a forward axial direction relative to the drive body 15.

The torque from the drive body 15 is transmitted to the insert 13 by engagement of a respective insert engaging surface 77 with a respective trailing side surface 31 of the insert 13. Each insert engaging surface 31 extends forwardly and along a plane corresponding to the plane of the side surface 31 so that sufficient surface is in engagement to transmit the torque. The base surface 29 of the insert 13 engages and is supported by a respective lower surface 79 of a respective aperture 73 so that the rearward forces on the insert 13 during drilling caused by the forward thrust of the insert 13 against the work is transmitted to the drive body 15. The above description with respect to one aperture also applies to the other aperture due to similarity of construction. It is contemplated that a land may bridge the lower surfaces 79 to provide additional support surface.

An independent means for detachably securing the insert 13 to the drive body 15 is provided so that the insert 13 remains in place when being withdrawn from the drill hole and easily changed when worn. One such detachable securing means which is illustrated in the drawings includes a split keeper ring 81 mounted in a circumferential groove 83 adjacent the flanges 71 on the drive body 15. The keeper ring 81 includes a projecting key portion 85 which mates with a channel 87 in the drive body to prevent rotation of the keeper ring. A pair of tabs 89 project forwardly from the keeper ring 81 for engagement with respective side surfaces 31 of the insert 13 which project through respective apertures 73. The tabs 89 each include a circumferential protrusion 91 adapted to mate with a respective notched portion 93 on opposite side surfaces 31 of the insert 13 to prevent forward release of the insert 13 from the drive body 15. The keeper ring 81 biases the insert 13 against the respective insert engaging surface 77 of flanges 71. To remove a worn insert, the keeper ring 81 is spread apart and removed from the drive body 15 in the forward axial direction. The insert 13 is then removed and a new insert 13 positioned and keeper ring 81 installed in the groove 83.

INDUSTRIAL APPLICABILITY

The mining drills are particularily useful for drilling coal mine roof bolt holes.

I claim:

1. A mine drill for aiding collection of detritus during drilling comprising a drive body being cylindrically and tubularly shaped about an axis of rotation and having an axial passage for the flow of detritus, an elongated insert mounted at the forward end of said drive body for movement about said axis of rotation whereby leading insert surfaces are presented forward of trailing insert surfaces in the direction of rotation, said insert forwardly projecting cutting edges, a base surface, side surfaces intermediate end portions and normal to said base surface extending toward said cutting edges, said base surface lying in a plane substantially normal to the axis of rotation, said drive body having a support surface and a pair of flanges projecting forwardly in an axial direction forming a pair of diametrically opposed passageways for the flow of detritus, each flange being an extension of the tubularly shaped drive body, each passageway being formed by a respective outwardly facing insert surface and inwardly facing flange surface, each flange having an insert engaging surface projecting in the axial direction for transmitting torsional forces of said drive body to said insert, said drive body including a circumferential groove adjacent said flanges said, insert being mounted to said drive body with said base surface engaging said support surface and said respective trailing insert surfaces, a keeper ring including a projecting key portion mounted in said circumferential groove, said keeper ring including a pair of tab portions projecting in the forward direction, each tab having a protrusion projecting in the circumferential direction, said insert including a pair of notches, each notch being positioned on a respective side surface for receiving a respective tab portion, each tab engaging a respective notch for preventing forward release of said insert.

* * * * *